US005080308A

United States Patent [19]

Franks

[11] Patent Number: 5,080,308

[45] Date of Patent: Jan. 14, 1992

[54] BAG SUPPORT

[75] Inventor: Gordon Franks, Lancaster, Minn.

[73] Assignee: Management Performance Associates, Ltd., Grand Forks, N. Dak.

[21] Appl. No.: 593,996

[22] Filed: Oct. 9, 1990

[51] Int. Cl.[5] ..... B65B 67/04

[52] U.S. Cl. ..... 248/99

[58] Field of Search ..... 248/99, 97, 100, 101, 248/95; 294/1.1

[56] References Cited

U.S. PATENT DOCUMENTS

| | | | |
|---|---|---|---|
| 481,957 | 9/1892 | Klank | 248/99 |
| 836,966 | 11/1906 | Gerson | 248/100 |
| 3,155,356 | 11/1964 | Montgomery | 248/99 |
| 3,161,391 | 12/1964 | Bahnsen | 248/99 |
| 3,744,081 | 7/1973 | Miller | 248/101 X |
| 4,023,842 | 5/1977 | Harvey | 248/99 X |
| 4,664,348 | 5/1987 | Corsaut, III et al. | 248/99 |

FOREIGN PATENT DOCUMENTS

| | | | |
|---|---|---|---|
| 0053814 | 11/1923 | Sweden | 248/97 |

*Primary Examiner*—Ramon O. Ramirez

*Attorney, Agent, or Firm*—Merchant, Gould, Smith, Edell, Welter & Schmidt

[57] ABSTRACT

An apparatus is disclosed for maintaining the mouth of a bag in an open position. The apparatus includes a base which is sized to be received within the bag and a pair of spaced apart support arms secured to the base. Each of the support arms include two rigid portions connected by a resilient member.

4 Claims, 1 Drawing Sheet

BAG SUPPORT

BACKGROUND OF THE INVENTION

1. Field of the Invention

This invention pertains to a device to facilitate collection and removal of material into a container. More particularly, this invention pertains to a device for holding the mouth of a bag in an open position.

2. Description of the Prior Art

In the prior art, devices are known for holding a flexible bag (such as a common plastic garbage bag) in an open position. Such devices are used for collecting litter or to assist in lawn raking and such. Examples of such prior art apparatus are shown in U.S. Pat. No. 4,550,440, U.S. Pat. No. 4,318,521 and U.S. Pat. No. 4,846,427.

An apparatus for holding a garbage bag or the like in an open position should be inexpensive and easy to operate. Further, it is desirable that such an apparatus be readily adjustable to accommodate bags of multiple sizes. It is an object of the present invention to provide such an apparatus.

SUMMARY OF THE INVENTION

According to a preferred embodiment of the present invention, an apparatus is disclosed for maintaining the mouth of a bag in an open position. The apparatus includes a base sized to be received within a bag and a pair of support arms. Each of the support arms is flexible to bend inwardly to accommodate bags of various sizes.

DESCRIPTION OF THE PREFERRED EMBODIMENT

Figure 1:
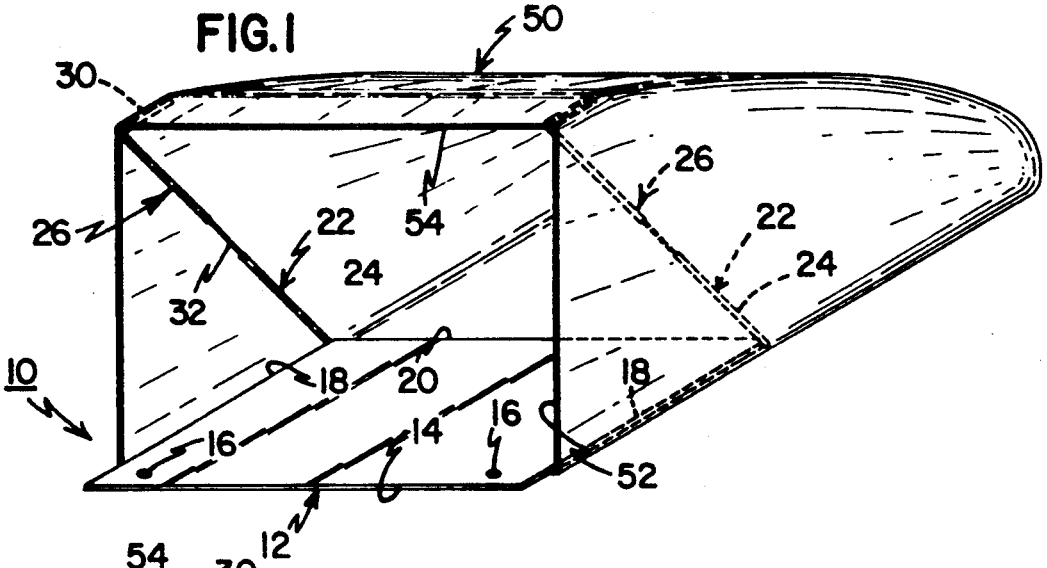
FIG. 1 is a perspective view of the apparatus of the present invention shown in use holding a bag in an open position.

With reference to the various drawings figures in which identical elements are numbered identically throughout, a description of the preferred embodiment of the present invention will now be provided.

The apparatus 10 of the present invention is a device intended to be used in holding open plastic garbage bags of various sizes. The device 10 can be wall mounted or be portable.

The device 10 includes a backboard 12 which is preferably rectangular and in a preferred embodiment will be about 20 inches wide by 13 inches high. The backboard can be made of any material such as plastic or steel. If made of steel, it is desirable that the side edges of the backboard 12 will be bent over so as to prevent a sharp edge which might otherwise rip or tear a plastic bag. A leading edge 14 of the backboard 12 is provided with a pair of spaced apart holes 16 to accommodate screws or the like to permit attachment of the backboard 12 to a wall if desired.

Side edges 18 extend from the leading edge 14 and terminate at a trailing edge 20. A pair of support rods 22 at the intersection of side edges 18 and trailing edges 20.

Each of support rods 22 is identical and a description of one will suffice as a description of the other.

Rods 22 each include a first rigid portion 24 which extends upwardly and away from side edges 18 in a common plane with side edges 18. The first rigid portions 24 form an angle, A, of preferably about 60° with side edges 18. In a preferred embodiment, the first rigid portions 24 have a length of about eight inches.

Figure 2:
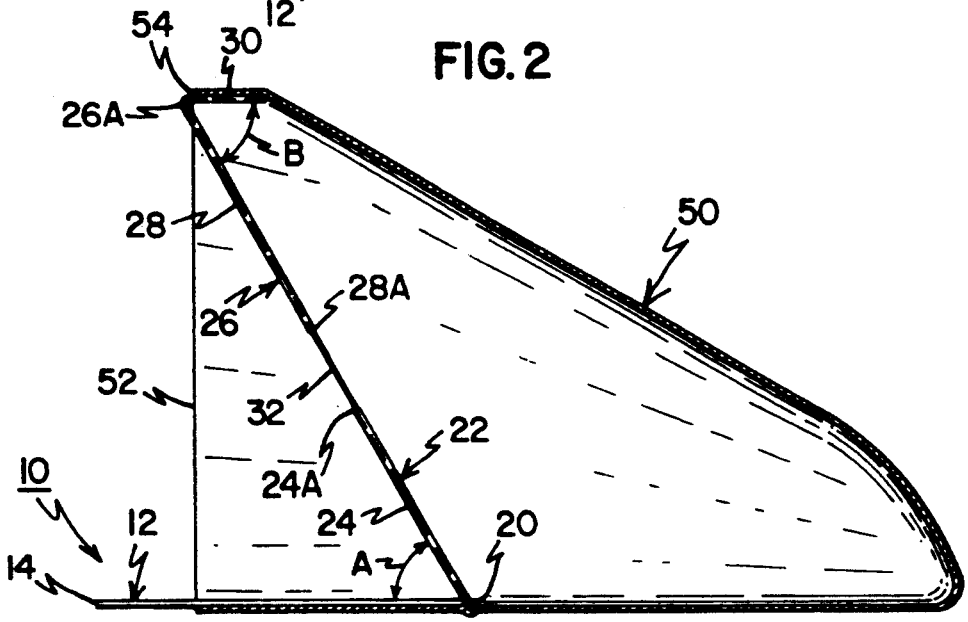
FIG. 2 is a side elevation cross-sectional view of the apparatus of FIG. 1.

The support rods 22 also include second rigid members 26 which are generally V-shaped in configuration having a major leg 28 and a minor leg 30 separated by an angle 1B, which is 60° in a preferred embodiment. For use with maintaining plastic garbage bags in an open position, it is desirable that the major leg 28 be about nine inches and the minor leg 30 be about three inches. A free end **28*a* of major leg 28 is connected to a free end 24*a* of first portion 24 (see FIG. 2). To connect ends 28*a* and 24*a*, a length of straight spring steel 32 is provided which in a preferred embodiment is about 2¼ inches long. The spring steel 30 is resilient but in a relaxed state will retain leg 28 in co-linear alignment with first rigid portion 24. Also, portion 26 is connected to portion 24 in a manner with minor leg 30 extending rearwardly away from the apex 26*a* of second rigid portion 26**.

With the structure thus described, the apparatus 10 may be used to retain a plastic garbage bag 50 in an open position. Specifically, the apparatus 10 is inserted within the mouth 52 of the bag so that the backboard 12 is fully received within the bag and with the minor leg 30 acting as a grip against the upper edge 54 of the bag. Resilience of springs 32 acts to hold the bag open.

Figure 3:
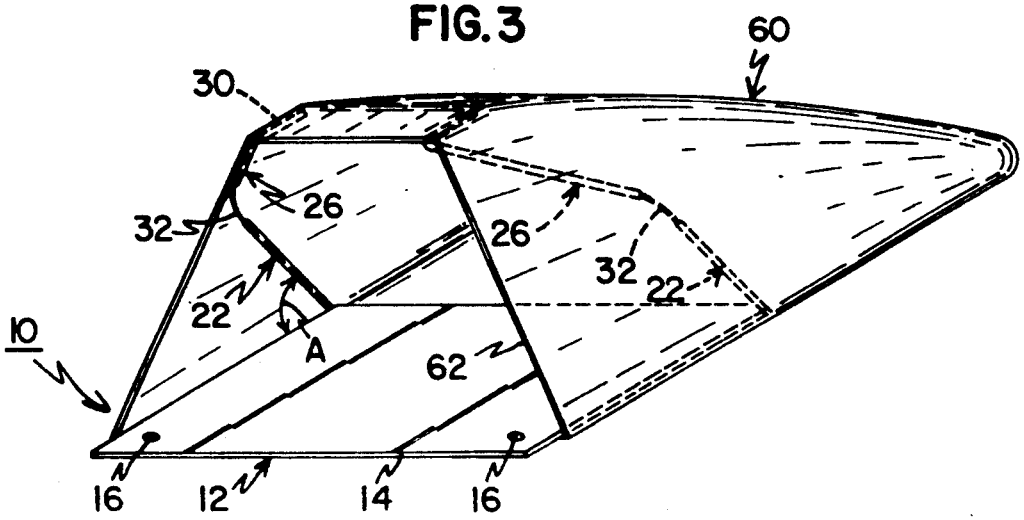
FIG. 3 is the view of FIG. 1 showing a bag (of smaller size than that shown in FIG. 1) in use with the present invention illustrating the adaptability of the apparatus for use with various size bags.

The apparatus can fit many different sizes of bags. For example, in FIG. 3, the apparatus is shown being used with a bag 60 having a mouth 62 of smaller diameter than the mouth 52 of bag 50 of FIGS. 1 and 2. As shown in FIG. 3, the springs 32, due to their resilience, permit the upper rigid portions 26 to bend inwardly toward one another to accommodate the smaller sized bag mouth 62. In addition to permitting use with a smaller sized bag, the force of the springs 32 retain the bag mouth 62 in an open position. In a preferred embodiment, the springs 32 are selected such that they present a force of about three to three and a half pounds when leg 28 is bent downwardly to be parallel with backboard 12.

Having described how the objects of the invention have been attained in the preferred embodiment, modifications and equivalents of the disclosed concepts may occur to one having ordinary skill in the art. It is intended that the scope of the present invention include all such modifications and equivalents.

What is claimed is:

1. An apparatus for maintaining a mouth of a bag in an open position, said apparatus comprising:

a base;

first and second spaced apart support arms having first ends secured to said base and extending from said first ends to second ends;

said support arms each including a first rigid linearly extending member extending from said first end to a distal end and a second rigid linearly extending member extending from a proximal end to said second end;

flexible resilient means connecting said distal ends of said first rigid members to said proximal ends of said second rigid members for said first ends to be resiliently flexible relative to said second ends, said resilient means biased to urge said first and second rigid members into colinear alignment while permitting said second rigid members to be moved against a bias of said resilient means to a noncolinear alignment relative to said first rigid members, said resilient means formed of a material different from a material of said rigid members to be substantially flexible with said rigid members formed of a substantially inflexible material, said flexible resilient member selected for said distal ends to move toward one another and to move toward said base.

2. An apparatus according to claim 1 wherein said first rigid members are connected to said base at a lesser included angle of less than 90°.

3. An apparatus according to claim 2 wherein said second member includes grip means for gripping an upper edge of a bag opposite said base member.

4. An apparatus for maintaining a mouth of a bag in an open position, said apparatus comprising:

a base member sized to be received within a bag;

first and second spaced apart support arms secured to said base with each of said support arms including a pair of rigid, nonflexible support members connected in colinear alignment by flexible resilient biasing means positioned between said rigid support members at an intermediate location along a length of said support arms, said resilient biasing means positioned between said rigid support members at an intermediate location along a length of said support arms, said resilient biasing means selected to bias said rigid support members into said colinear alignment while permitting connected members to be urged out of colinear alignment against a bias of said resilient biasing means in a plurality of flexed positions, said flexible resilient member selected for free ends of said non-flexible support members to move toward one another as well as toward said base.

* * * * *